US005117756A

United States Patent [19]

Goffin, II

[11] Patent Number: 5,117,756

[45] Date of Patent: Jun. 2, 1992

[54] METHOD AND APPARATUS FOR A CALIBRATED ELECTRONIC TIMING CIRCUIT

[75] Inventor: Glen P. Goffin, II, Newtown, Pa.

[73] Assignee: Atlas Powder Company, Dallas, Tex.

[21] Appl. No.: 585,631

[22] Filed: Sep. 20, 1990

Related U.S. Application Data

[62] Division of Ser. No. 306,507, Feb. 3, 1989, abandoned.

[51] Int. Cl.[5] ..... F23Q 21/00

[52] U.S. Cl. ..... 102/217; 102/218

[58] Field of Search ..... 331/1 R, 1 A, 30, 18, 331/11, 14, 25; 375/10, 11; 102/217, 218, 220, 206, 200

[56] References Cited

U.S. PATENT DOCUMENTS

| | | | |
|---|---|---|---|
| 3,185,938 | 5/1965 | Pelosi | 331/1 A |
| 3,500,746 | 3/1970 | Ambrosini | 89/6.5 |
| 3,646,371 | 2/1972 | Flad | 307/293 |
| 3,748,589 | 7/1973 | Miller | 331/1 A |
| 3,793,594 | 2/1974 | Griswold | 331/4 |
| 3,806,826 | 4/1974 | Schlosser | 331/1 A |
| 3,851,589 | 12/1974 | Meyer | 317/80 |
| 3,866,137 | 2/1975 | Steel | 331/18 |
| 3,889,204 | 6/1975 | Schlosser | 331/1 A |
| 4,068,592 | 1/1978 | Beuchat | 102/215 |
| 4,095,527 | 6/1978 | Moore III | 102/206 |
| 4,136,617 | 1/1979 | Fowler | 102/206 |
| 4,145,970 | 3/1979 | Hedberg et al. | 102/218 |
| 4,324,182 | 4/1982 | Kirby et al. | 102/217 |
| 4,328,751 | 5/1982 | Oswald | 102/220 |
| 4,395,950 | 8/1983 | Oswald | 102/200 |
| 4,445,435 | 5/1984 | Oswald | 102/215 |
| 4,454,815 | 6/1984 | Beck | 102/206 |
| 4,487,125 | 12/1984 | Zuk | 102/206 |
| 4,527,636 | 7/1985 | Bordon | 102/217 |
| 4,556,437 | 5/1986 | Miki et al. | 102/206 |
| 4,572,288 | 2/1986 | Kinley | 102/206 |
| 4,601,243 | 7/1986 | Ueda et al. | 102/206 |
| 4,623,779 | 11/1986 | Raab | 219/222 |
| 4,632,031 | 12/1986 | Jarrott et al. | 102/206 |
| 4,633,779 | 1/1987 | Biggs et al. | 102/215 |
| 4,646,640 | 3/1987 | Florin et al. | 102/217 |
| 4,674,047 | 6/1987 | Tyler et al. | 102/206 |
| 4,712,477 | 12/1987 | Aikou et al. | 102/206 |
| 4,730,558 | 3/1988 | Florin et al. | 102/218 |
| 4,810,974 | 3/1989 | Hulbert et al. | 331/1 A |
| 4,825,765 | 5/1989 | Ochi et al. | 102/206 |
| 4,860,653 | 8/1989 | Abouav | 102/200 |

FOREIGN PATENT DOCUMENTS

| | | | |
|---|---|---|---|
| 138008 | 4/1985 | European Pat. Off. | 331/1 A |
| 17235 | 1/1982 | Japan | 331/1 A |
| 2093286 | 8/1982 | United Kingdom | 102/217 |

*Primary Examiner*—Deborah L. Kyle
*Assistant Examiner*—Stephen Johnson
*Attorney, Agent, or Firm*—Richards, Medlock & Andrews

[57] ABSTRACT

A timing circuit includes a variable frequency oscillator which has a control signal that determines the output frequency of the oscillator. The control signal and a reference signal are stored in the circuit. A precision calibration pulse is applied to the timing circuit which counts the output cycles of the variable frequency oscillator during the period of the pulse. This count is stored and compared to the reference count to produce an error count. This error count is combined with the previously stored control signal to produce a new control signal that drives the output of the oscillator to a new frequency. The timing circuit can be utilized as a part of a delay circuit is an electronic blasting system wherein a control unit transmits the calibration pulse concurrently to each of the delay circuits to cause each circuit to calibrate its local oscillator in accordance with the calibration pulse. The control unit transmits a delay count to each of the delay ignition circuits. A fire command is transmitted from the control unit to each of the delay ignition circuits to cause the outputs of the calibrated local oscillators to be compared to the previously received delay count until a predetermined relation is reached. When this relation is reached, each delay ignition circuit generates a fire signal which ignites a corresponding explosive element.

3 Claims, 6 Drawing Sheets

32 DETONATOR BLOCK DIAGRAM

*DETONATOR BLOCK DIAGRAM*

COMMAND DECODER

DELAY COUNTER

METHOD AND APPARATUS FOR A CALIBRATED ELECTRONIC TIMING CIRCUIT

This is a division of U.S. application Ser. No. 306,507, filed Feb. 3, 1989 now abandoned.

FIELD OF THE INVENTION

The present invention pertains in general to the calibration of an electronic timing circuit and in particular to the use of calibrated time delay circuits for the delayed ignition of explosive products.

BACKGROUND OF THE INVENTION

In applications of electronic timing circuits it is often necessary to use an inexpensive timing oscillator due to economic and size constraints. However, the necessary accuracy required by the timing circuit is greater than the precision of the inexpensive oscillator. Thus, some means must be provided to calibrate such an oscillator by use of a more precise timing reference. This reference can be used repeatedly to calibrate a large number of the low precision oscillators.

One particular application which requires such calibration is in the field of electronic detonation of explosives. In blasting operations, it is important to efficiently utilize the blasting power of the explosives. This power must be used to achieve a maximum breakage of rock into desired sizes for a given amount of explosive material. It is further becoming increasingly important to minimize the effects of blasting on nearby structures by reducing the peak-to-peak amplitude and frequency of ground vibration produced by such a blast. The principle method for achieving these objectives is to time the ignition of a plurality of the explosive units which are placed at selected locations within an area of operation. These explosive units are detonated at intervals over a short period of time. This time-spaced detonation better applies the explosive power to the breakage of rock and at the same time reduces the peak amplitude of ground vibrations. The best results are achieved when the delay ignition can be precisely timed. However, it is difficult to achieve such required accuracy with a product which is used only once and which must be moderately priced for large volume application.

Both electric and nonelectric delay blasting caps and circuits have been previously developed. The nonelectric units are typically based upon the burning time for a pyrotechnic mixture. However, such burning time has a serious limitation in its accuracy. This limitation of accuracy prevents the optimum timing of the ignition events.

Numerous electronic detonator circuits have been proposed to achieve greater accuracy over pyrotechnic devices. Examples of such circuits are shown in U.S. Pat. Nos. 4,674,047 entitled "Integrated Detonator Delay Circuits and Fire Console", 3,851,589 entitled "Electronic Delay Blaster", 4,136,617 entitled "Electronic Delay Detonator", 4,324,182 to Kirby et al. entitled "Apparatus and Method for Selectively Activating Plural Electrical Loads at Predetermined Relative Times", 4,445,435 entitled "Electronic Delay Blasting Circuit", 4,395,950 entitled "Electronic Delay Blasting Circuit", 4,328,751 entitled "Electronic Delay Blasting Circuit", 4,145,970 entitled "Electronic Detonator Cap", 4,136,617 entitled "Electronic Delay Detonator", 4,095,527 entitled "Specialized Detonator Firing Circuit", 4,730,558 entitled "Electronic Delay-Action Explosive Detonator", 4,712,477 entitled "Electronic Delay Detonator", 4,646,640 entitled "Process and Apparatus for Chronologically Staggered Ignition of Electronic Explosive Detonating Devices", 4,623,779 entitled "Timing Apparatus for Fuse", 4,632,031 entitled "Programmable Electronic Delay Fuse", 4,601,243 entitled "Method and Apparatus for Electronically Detonating Blasting Primers", 4,586,437 entitled "Electronic Delay Detonator", 4,487,125 entitled "Timing Circuit", 4,454,815 entitled "Reprogrammable Electronic Fuse", 3,851,589 entitled "Electronic Delay Blaster", 3,646,371 entitled "Integrated Timer with Nonvolatile Memory", and 3,500,746 entitled "Weapons System with an Electronic Time Fuse".

The principle problem encountered in the use of electronic delay detonators is the accuracy of the timing mechanism (clock signal, RC time constant, etc.) within the delay circuit itself. There are numerous constraints upon the use of the local oscillator within the delay circuits. Such an oscillator should not be subjected to rate variations as a result of change in pressures, which will be experienced when one unit receives the pressure wave from the ignition of another unit. Further, fluctuations in ambient temperature, humidity and pressure can cause an oscillator to vary in its rate.

It can therefore be seen that it is important to have a method for calibrating the local oscillator in a timing circuit, such as used in electronic ignition delay circuits, so that accurate time delays between detonations can be achieved while at the same time doing so in a manner that is reliable, inexpensive and rapid.

SUMMARY OF THE INVENTION

A selected embodiment of the present invention is a method for calibrating the frequency of the signal produced by a timing circuit by use of a separate time reference. In a first step, a calibration pulse is derived from the time reference and provided to the timing circuit. Included within the timing circuit is a variable frequency oscillator wherein the output frequency of the oscillator is determined by a control signal provided to the oscillator. The output of the oscillator is counted during the period of the calibration pulse to produce a rate signal which is proportional to the number of cycles of the output signal produced during the calibration pulse. The rate signal produced is next compared to a predetermined reference signal to produce an error signal. The control signal is changed by a proportion to the error signal to produce a new control signal which causes the oscillator to produce an output signal having a new frequency that is closer than the previous output signal frequency to a predetermined timing relation to the time reference.

In a further embodiment of the present invention, the timing circuit described above is utilized within a delay ignition circuit of a blasting system having a plurality of such circuits connected to a central control unit which includes the time reference. Each of the oscillators within the delay ignition circuits is calibrated by use of the method described above. A delay count is then transmitted to each of the individual delay ignition circuits. Upon receipt of a fire command from the control unit, each of the delay circuits begins to count the output of its corrected local oscillator until a predetermined relation to the previously received delay count is reached. Upon reaching this predetermined relation, such as a comparison, each delay circuit causes generation of a fire signal which causes an explosive element associated with the delay circuit to be ignited.

BRIEF DESCRIPTION OF THE DRAWINGS

For a more complete understanding of the present invention and the advantages thereof, reference is now made to the following description taken in conjunction with the accompanying drawings in which.

DETAILED DESCRIPTION

Figure 1:
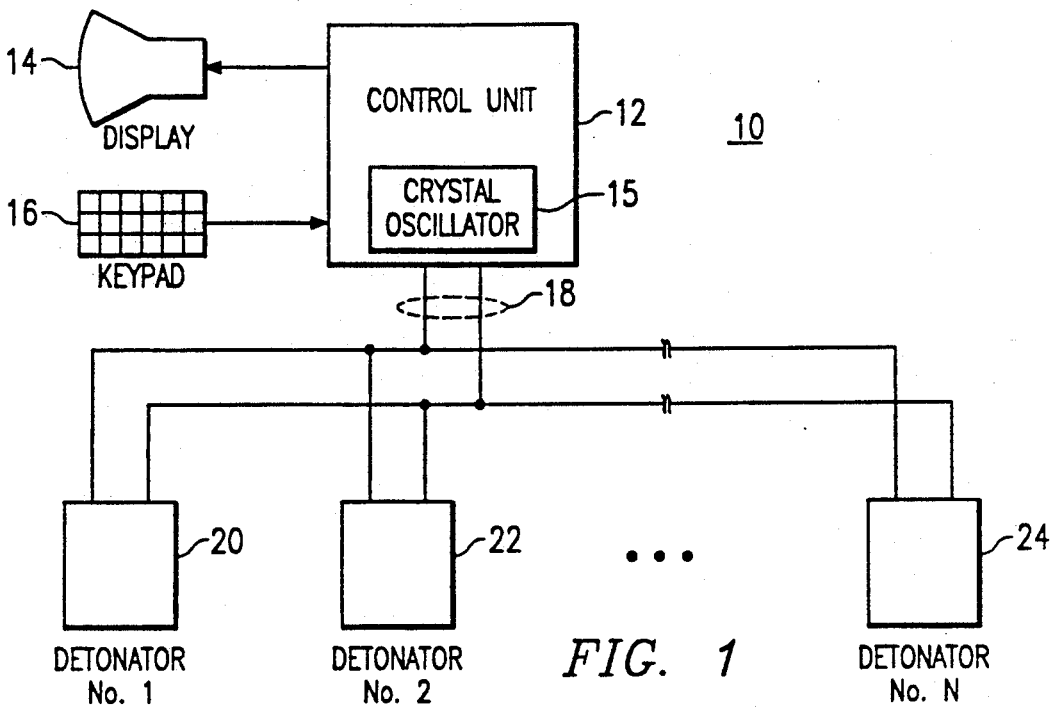
FIG. 1 is a block diagram illustrating a blasting system having a control unit connected to a plurality of detonators.

The present invention is directed to the calibration of a timing circuit which may be used in many applications. This timing circuit employs a unique calibration method that permits a relatively inexpensive and compact local oscillator to be calibrated to have a relatively high precision by comparison to a more accurate time reference. In a particular application of the invention, the timing circuit is utilized within a delay ignition circuit which is a part of a blasting system. Referring now to FIG. 1, there is illustrated a general block diagram of such a system. A blasting system 10, which utilizes the present invention, includes a control unit 12 having a display 14 and a key pad 16. A stable crystal oscillator 15 is included as a part of the control unit 12. The control unit 12 has two leg wires 18 which are connected in parallel to the inputs of detonator circuits 20, 22 and 24. A substantial number of such detonator circuits may be connected in parallel to the wires 18.

Briefly, in operation, an operator inputs commands through the keypad 16 to the control unit 12 for determining the time delay for each of the detonators, such as 20, 22 and 24. Each detonator can be individually addressed to provide a particular delay time. The control unit 12 provides a calibration pulse or pulses concurrently to each of these detonator circuits for calibrating the local oscillator within each circuit. After this calibration has taken place, the operator sends a start command to each of the detonator circuits which initiates a time delay followed by igniting a local explosive element. The invention is described in further detail in reference to the following figures.

Figure 2:
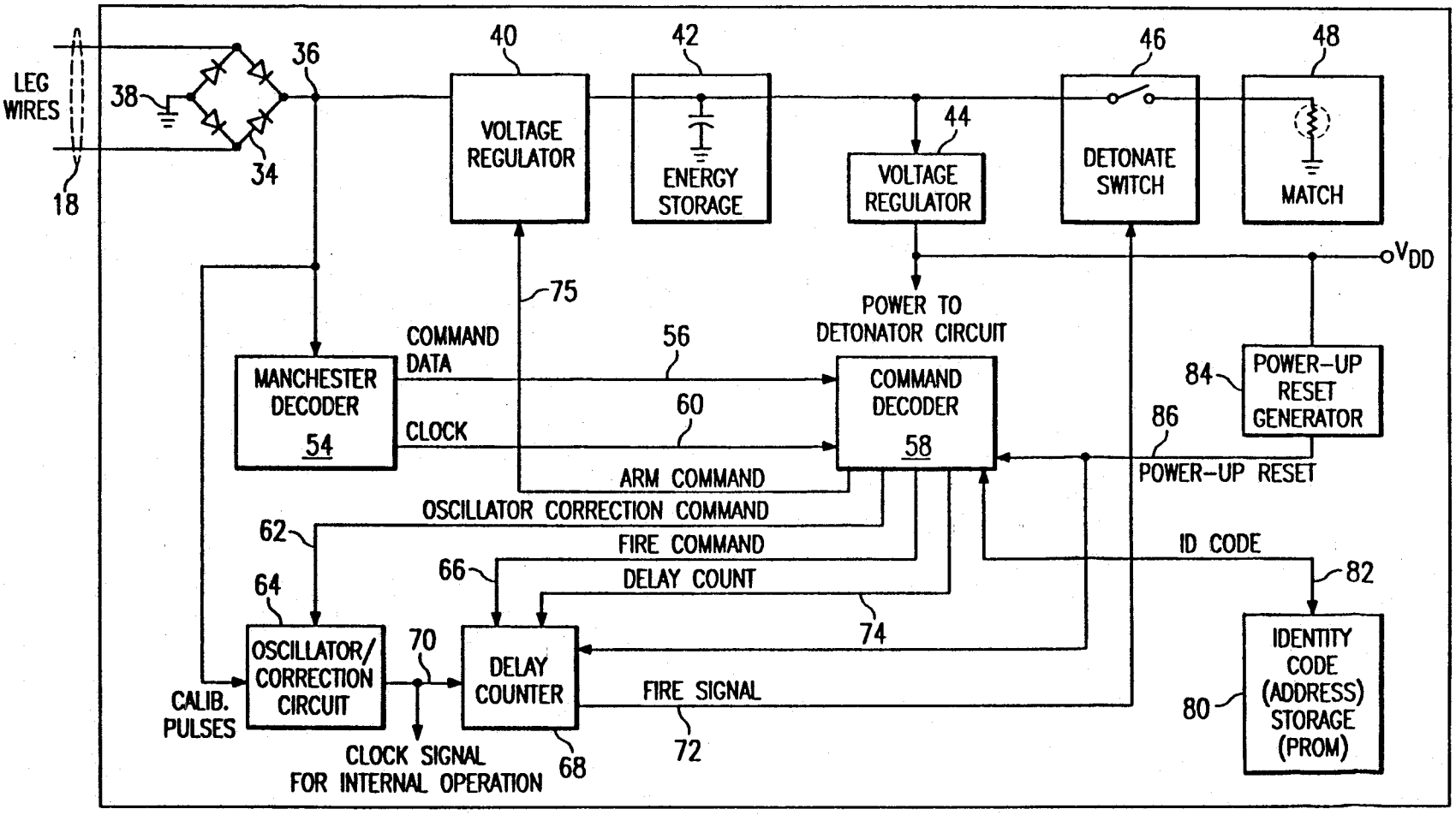
FIG. 2 is a functional block diagram of a delay detonator circuit in accordance with the present invention.

A detailed block diagram of a preferred embodiment of the present invention is shown in FIG. 2. A detonator circuit 32 is connected to the leg wires 18, as shown in FIG. 1. The leg wires 18 are connected to a bridge rectifier 34 which has output nodes 36 and 38. The rectifier 34 rectifies the input signal to produce a desired polarity of power for the detonator 32 as well as to provide polarity independent connection to the leg wires 18. The node 36 is connected to a voltage regulator 40 which provides first and second regulated voltages for charging an energy storage element 42, which is preferably a capacitor. A second voltage regulator 44 is connected to the energy storage element 42 and provides a regulated voltage for powering the logic portion of an integrated circuit embodying the detonator circuit 32. The energy storage element 42 is further connected to a detonate switch 46 that is in turn connected to a resistive match 48, which is an explosive element. In a blasting cap application the match 48 is adjacent to a charge which is ignited by the match and in turn leads to ignition of a primary explosive.

The node 36 is further connected to transfer an input signal from the leg wires 18 to a Manchester decoder 54 which demodulates incoming signals through the leg wires 18 to produce commands and data for use by the detonator circuit 32. The Manchester decoder 54 is a conventional circuit utilized in digital communications. The decoder 54 produces command data which is transferred through a line 56 to a command decoder 58. The decoder 54 also extracts a clock signal from the incoming data on the leg wires, 18 and this clock signal is transmitted through a line 60 to the command decoder 58. The command decoder 58 is further described in reference to FIG. 7.

The command decoder 58 produces a number of control signals. An oscillator correction command is transmitted through a line 62 to an oscillator/ correction circuit 64. The node 36, at the output of the bridge rectifier 34, is further connected to the input of the circuit 64.

The command decoder 58 produces a fire command signal which is transmitted through a line 66 to a delay counter 68. The clock output of the circuit 64 is connected through a line 70 to the input of the delay counter 68. The delay counter 68 produces a fire signal which is transmitted through a line 72 to the switch 46. The command decoder 58 produces an arm command which is transmitted through line 75 to the voltage regulator 40. Upon receipt of this command, the voltage regulator 40 increases its output voltage to store a greater charge at the energy storage 42.

The command decoder 58 further transmits a delay count through a line 74 to the delay counter 68. The delay count is a number which is received as data through the leg wires 18 from the control unit 12.

The detonator circuit 32 further includes an identity code storage 80 which is connected through a line 82 to the command decoder 58. The identity code storage 80 is typically a programmable read only memory (PROM) which has stored therein an address that is unique to each particular detonator circuit 32.

Operation of the detonator circuit 32 is now briefly described. The circuit 32 includes a timing portion which provides calibration of the local oscillator which is within the circuit 64. This operation is described in more detail below. The detonator circuit 32 receives both power and commands through the leg wires 18. The commands are typically transmitted using pulse code modulation and when commands are not being transmitted through the leg wires 18, there will be provided a dc level that is rectified by the bridge rectifier 34 and utilized to store energy at the energy storage 42. However, the present invention is not limited to dc operation only, alternating current signals could likewise provide both the power and signalling for the detonator circuit 32. Although pulse code modulation is the preferred form of communication, other communication techniques may likewise be utilized such as frequency modulation, frequency shift keying, amplitude modulation or phase modulation. After the leg wires 18 have been connected to the control unit 12 for a period of time the capacitor within the energy storage 42 will be charged in a pre-armed state at a voltage, such as 10 volts. The voltage regulator 44 will reduce this to approximately 5 volts for powering the remainder of the detonator circuit 32. In a subsequent step leading to ignition, the voltage level at the leg wires 18 will be increased so that the capacitor within the energy storage 42 is charged to a level of approximately 20 volts, after receipt of the arm command through line 75.

The detonator circuit 32 further includes a powerup reset generator 84 which is connected to the output of the voltage regulator 44. The purpose of this circuit is to generate a power-up reset command at a line 86 which is provided to the command decoder 58 and to the delay counter 68. This circuit generates the reset command when the power first comes up and reaches an acceptable level for operation of the circuit 32. This command sets various parts of the circuit, described below, to a necessary initial condition.

Upon receipt of an arm command through the leg wires 18 from the control unit 12, the voltage regulator 40 permits the charging of the capacitor within energy storage 42 to approximately 20 volts. When the fire signal is ultimately produced by the delay counter 68, the detonate switch 46 will be closed to connect the energy storage 42 to the match 48. There will be sufficient energy in the energy storage 42 to cause ignition of the match 48 and a subsequent ignition of adjacently located explosives.

The time calibration of the present invention is carried out by transmitting a calibration pulse or pulses from the control unit 12 through the leg wires 18 and into the oscillator/correction circuit 64. This calibration pulse is generated by a precision reference, such as the crystal oscillator 15, located within the control unit 12. The leading edge of the calibration pulse causes the local oscillator within the circuit 64 to generate an output which is measured, and then corrected, in a method further described below. The control unit 12 further transmits a delay count through the leg wires 18, which is passed through the Manchester decoder 54 to the command decoder 58. This count is then provided by the decoder 58 to the delay counter 68. Upon receipt of a fire command from the control unit 12 the command decoder causes the delay counter 68 to receive the clock output from the oscillator in circuit 64 and this output is compared to the stored delay count until a predetermined relation is reached, typically a match. Upon reaching this predetermined relation, the fire signal is generated and transmitted through line 72 to the detonate switch 46. As noted above, this causes ignition of the match 48.

Figure 3:
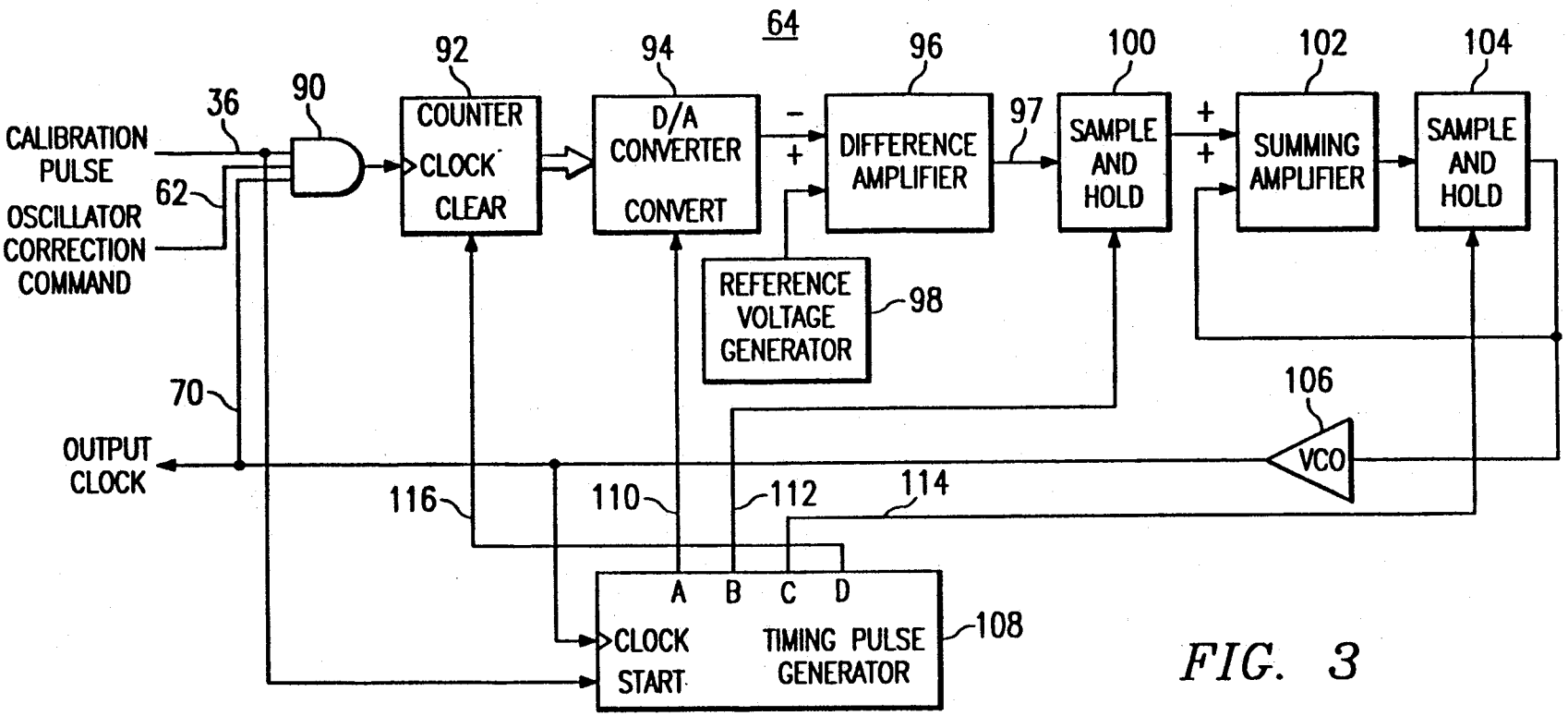
FIG. 3 is a schematic and functional embodiment for an analog oscillator/correction circuit as shown in FIG. 2.
Figure 5:
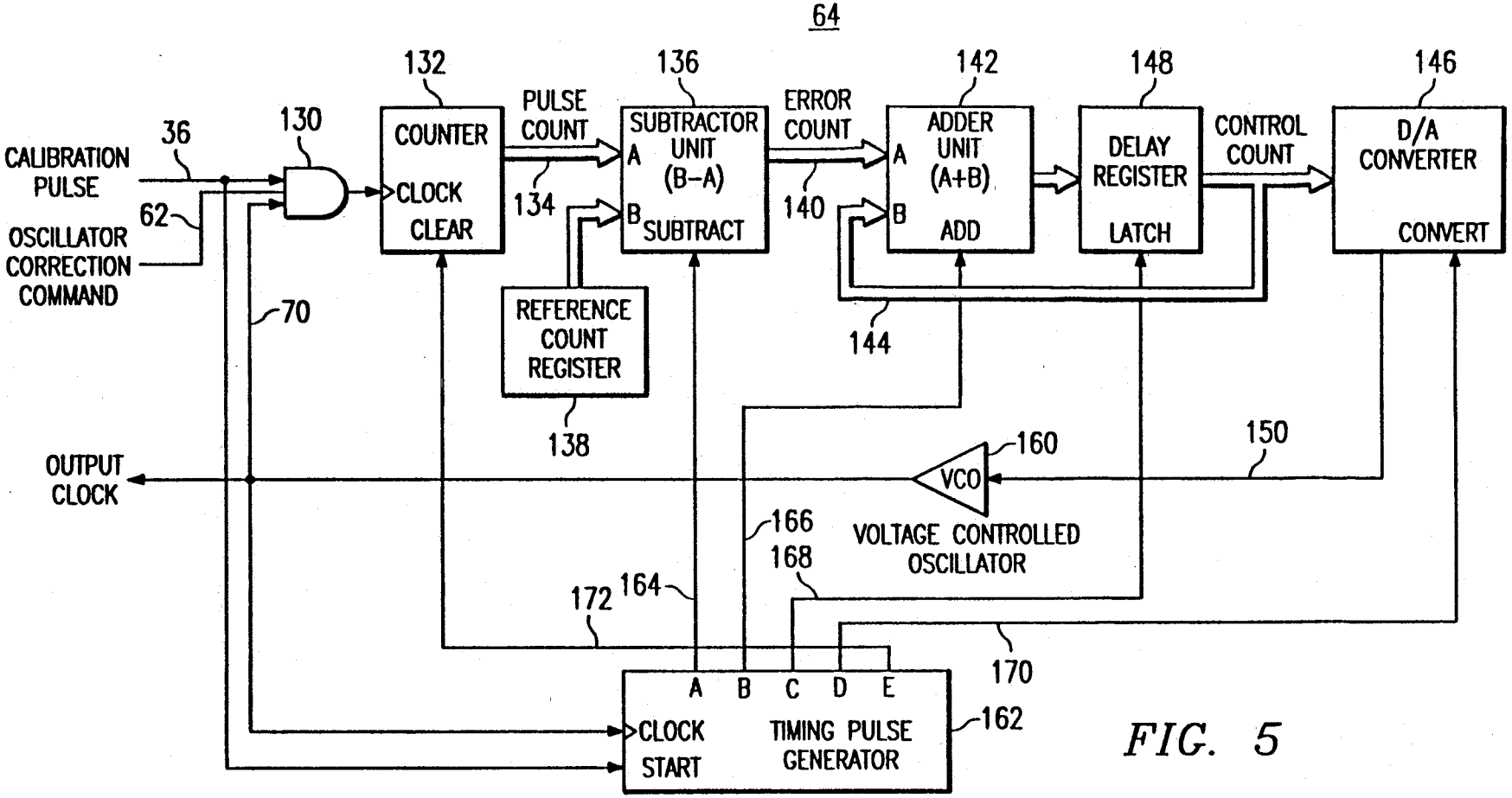
FIG. 5 is a functional block diagram for a digital embodiment of the oscillator/correction circuit illustrated in FIG. 2.

The oscillator/correction circuit 64 is shown as an analog embodiment in FIG. 3 and a digital embodiment in FIG. 5. The analog embodiment is now described in reference to FIG. 3. An AND gate 90 receives the calibration pulse through line 36 and the oscillator/correction command through line 62. The output of the gate 90 is connected to the input of a counter 92 which has the output thereof connected to a digital-to-analog converter 94. The analog output from the converter 94 is connected to the negative input of a difference amplifier 96. The positive input of the difference amplifier 96 is connected to a reference voltage generator 98. The output from the difference amplifier 96 is connected through a line 97 to a sample and hold circuit 100. The output from the sample and hold circuit 100 is provided to an input of a summing amplifier 102 which has the other input thereof connected to the output of a sample and hold circuit 104. The output from the amplifier 102 is connected to the input of the sample and hold circuit 104. The output from the sample and hold circuit 104 is further connected to the control input of a voltage controlled oscillator 106. The output of the oscillator 106 is a signal having a varying frequency and is transmitted through line 70. The output of the oscillator 106 is preferably a square wave signal, but this is not necessary to the operation of the invention.

Figure 4:
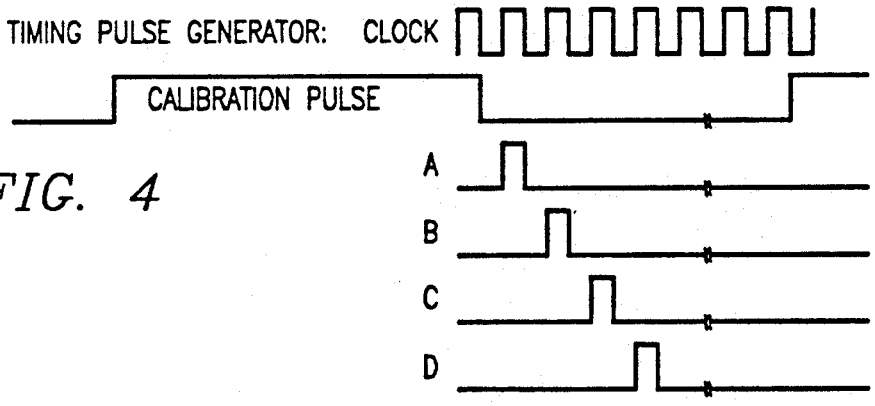
FIG. 4 is a timing diagram illustrating the generation of timing pulses for the timing pulse generator shown in FIG. 3.

The oscillator/correction circuit 64 further includes a timing pulse generator 108 which receives the clock signal from line 70 and further receives the calibration pulse from line 36, which serves to start the operation of the generator 108. The operation of the timing pulse generator is further described in reference to FIG. 4. As noted in this FIG. 4, the input clock signal is a periodic signal. The calibration pulse has a falling edge which initiates the operation of the generator 108. Upon receipt of this falling edge the timing signals A, B, C and D, as shown in FIG. 4, are produced. These timing signals A, B, C and D are transmitted respectively through lines 110, 112, 114 and 116. The A signal, transmitted through line 110, is connected to the digital-to-analog converter 94, causing it to produce a conversion. The B signal, transmitted through line 112, is provided to the sample and hold circuit 100 to cause it to take a sample from the output of the difference amplifier 96. The C signal, transmitted through line 114, is provided to the sample and hold circuit 104 and likewise causes it to sample the input thereto. The D signal transmitted through line 116 serves to clear the counter 92. The function of the signals A, B, C and D is to sequence the various signals through the circuitry within the circuit 64.

Figure 9:
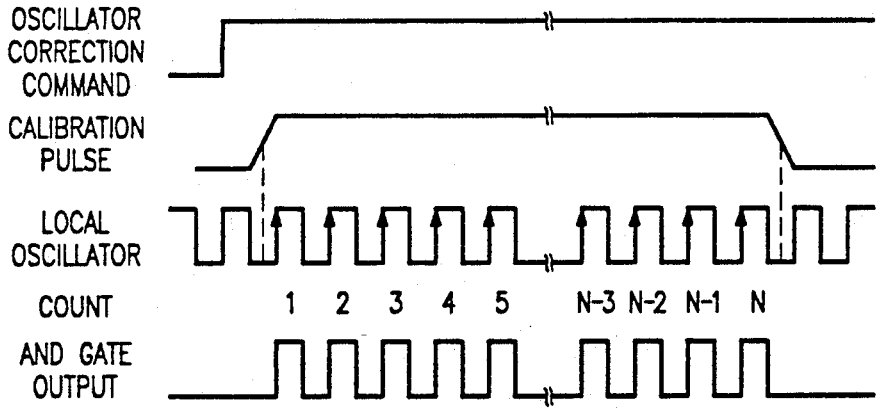
FIG. 9 is an illustration of timing wave forms demonstrating the operation of the method of the present invention.

Operation of the circuit 64 is now described in detail in reference to FIG. 3 as well as to FIG. 9. FIG. 9 illustrates the calibration pulse as well as the output of the oscillator 106.

The AND gate 90 is qualified when the oscillator/correction command is received through line 62 from the command decoder 58. This correction command is illustrated in FIG. 9 and is transmitted through line 62. The calibration pulse is also provided as an input to the AND gate 90. Likewise, the output of oscillator 106 is provided as an input. The output of the AND gate is shown as a lower trace in FIG. 9. Thus, the output of AND gate 90 comprises the output of the voltage controlled oscillator 106 during the time period of the calibration pulse. The output of the AND gate 90 is supplied to the counter 92 where a count of the pulses produced by the oscillator 106 is made and stored. This count is provided to the digital-to-analog converter 94 which produces a corresponding analog voltage when activated by the A signal through line 110. This analog voltage at the output of the converter 94 is provided to the difference amplifier 96 concurrently with a reference voltage from the generator 98. The difference between the two inputs to the amplifier 96 comprises an error signal which is transmitted through a line 97 to the sample and hold circuit 100. Sample and hold circuit 100 is in turn activated upon receipt of the B pulse through line 112 from the generator 108. The output signal from sample and hold circuit 100 is provided to the first input of the summing amplifier 102. This is combined with the control signal which is held in the sample and hold circuit 104. Note that the control signal is the input to the voltage controlled oscillator 106 and it is this control signal that determines the output frequency of the oscillator 106. When the error signal is combined with the previous control signal a new control signal is produced which is then provided to the sample and hold circuit 104. This new control signal is then input to the voltage controlled oscillator 106 to produce an output signal having a new frequency. It is the objective of this circuit to produce a new frequency that is closer to a predetermined timing relation with that of the precision oscillator 15 within the control unit 12. This procedure can be repeated a number of times to more accurately calibrate the output of the voltage controlled oscillator 106. The objective is to drive the error signal at line 97 to zero at which time the frequency output of the voltage controlled oscillator 106 will have a substantially calibrated value. The final frequency is a function of both the calibration pulse received at the AND gate 90 and the reference voltage produced by the generator 98. The reference voltage produced by generator 98 is a voltage which is equal to the voltage that should be produced from the converter 94 when the oscillator 106 produces the desired frequency.

A digital embodiment of the oscillator/correction circuit 64, shown in FIG. 2, is presented in FIG. 5. The circuit 64 includes an AND gate 130 which has three inputs. The first input is the calibration pulse on line 36. The second input is the oscillator correction command received through line 62 from the command decoder 58. The third input is the clock signal at line 70. The operation of the AND gate 30 is further described in reference to FIG. 9. Upon receipt of the oscillator calibration command as well as the calibration pulse, a group of clock pulses from line 70 are transmitted through the gate 130 to the clock input of a counter 132. The count of the number of pulses received during the calibration time period is stored in the counter 132. This pulse count is transmitted through a line 134 to the A input of a subtractor unit 136. The B input of the subtract unit 136 is connected to a reference count register 138 which provides a reference count to the unit 136. The subtractor unit 136 produces an error count which is the difference of the counts provided to the A and B inputs, which in this embodiment is B - A. This error count is transmitted through a line 140 to the A input of an adder unit 142. The output from the adder unit 142 is a control count which is transmitted to the input of a delay register 148. The control count is passed through the delay register and returned through a line 144 to the B input of the adder unit 142. Line 144 is also connected to the input of a digital-to-analog converter 146. The digital-to-analog converter 146 produces a control signal which is provided to a voltage controlled oscillator 160 which produces a clock output at the line 70.

Figure 6:
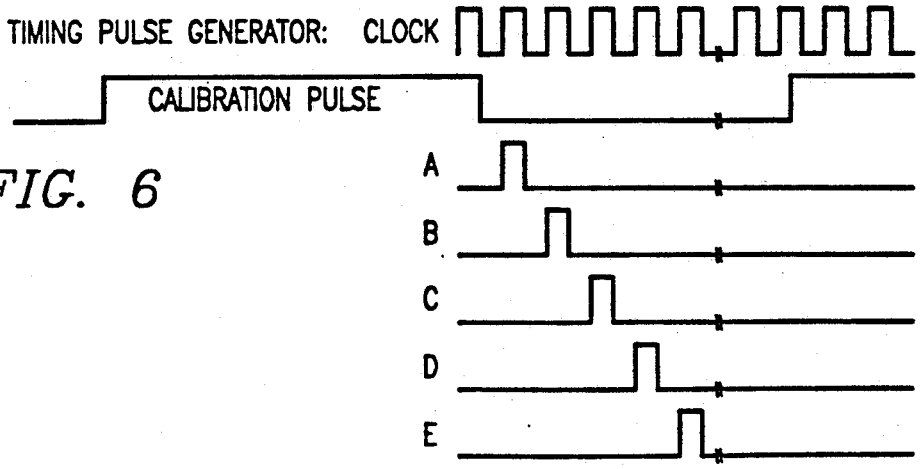
FIG. 6 is an illustration of wave forms for the timing pulse generator shown in FIG. 5.

The detonator circuit 64 further includes a timing pulse generator 162 for sequencing the operation of the circuit 64. The generator 162 receives the clock signal at line 70 as well as the calibration signal at line 36. The operation of the calibration input signal and the generated outputs for the generator 162 are shown in FIG. 6. The calibration pulse is received at the start input of the generator 162. The generation of the control pulses is initiated upon the receipt of the trailing edge of the calibration pulse. Upon receipt of this trailing edge, and in response to the clock signal, a series of timing pulses are generated. These are labeled as pulses A, B, C, D and E. Pulse A is transmitted through a line 164 to the subtractor unit 136 to cause this unit to produce the error count at line 140. Pulse B is transmitted through a line 166 to the adder unit 142 to cause this unit to add the inputs at A and B and produce the control count at line 144. Pulse C is transmitted through line 168 to the latch input of the delay register 148 to cause the control count to be shifted through the delay register 148. Pulse D is transmitted through line 170 to the convert input of the digital-to-analog converter 146 which causes the conversion of the digital input to produce an analog output signal, which is the control signal provided to the voltage controlled oscillator 160. The timing pulse E is transmitted through line 172 to the clear input of the counter 132. This clears the counter 132 in preparation for the next count from the AND gate 130 and the oscillator 160.

Operation of the detonator circuit 64 is now described in detail in reference to FIGS. 5, 6 and 9. The objective of this circuit is to drive the rate of the oscillator 160 to be in a predetermined relationship to the calibration pulse 36, which is produced by the crystal oscillator 15 within the control unit 12. For example, the crystal oscillator 15 within the control unit 12 may operate at a rate of 10 MHz. This crystal oscillator should have a very high stability on the order of $10^{-10}$. The calibration pulse transmitted through line 36 may have, for example, a duration of 1.0 second with an accuracy of 1 part in $10^6$ or $\pm$ 1 microsecond. The calibration pulse duration and accuracy is determined by the clock signal produced by the oscillator 15. Further, in a preferred embodiment, the voltage controlled oscillator 160 should be driven to have an output signal with a frequency of 100 KHz. Thus there is 100:1 timing relationship between the rates of the crystal oscillator 15 and the voltage controlled oscillator 160. In an ideal situation, the oscillator 160 would produce an output signal having exactly a rate of 100 KHz with an accuracy of 1 part in $10^6$. However, in an actual application, the oscillator 160 cannot be manufactured to have such precision. In most applications the variance of the rate may be off by as much as 10–20%, depending upon many variables such as manufacturing tolerances, temperature, humidity, pressure and any other factors. However, it is important that the oscillator 160 have a short term (approximately 10 seconds) stability on the order of 1 part in $10^6$. In the present embodiment, the predetermined timing relation between the time reference source, oscillator 15, and the voltage control oscillator 160 is 100:1. However, other relationships may likewise be utilized to produce the calibration in accordance with the method of the present invention. The actual rates and relationships are primarily dependent upon the desired accuracy of the time delay. In the present invention, it is the objective to achieve a time delay accuracy on the order of 10 microseconds with a maximum delay of 10 seconds. This equates to 1 part in $10^6$.

In operation, the calibration pulse is transmitted through line 36 to the AND gate 130. Previously, a calibration command has been received by the command decoder 58 to initiate the calibration procedure. . Decoder 58 generates the oscillator correction command at line 62. This enables the AND gate 130. Upon receipt of both the oscillator correction command and the calibration pulse, the output of the voltage controlled oscillator 160 is passed through the AND gate 130 to the counter 132. As a result, the counter produces a count of the number of pulses produced by the oscillator 160 during the calibration pulse interval. The reference count register 138 stores the ideal count that should have been produced during this interval had the voltage control oscillator 160 operated at the precise predetermined frequency. This reference count is compared to the pulse count, at line 134, in the subtractor unit 136. If the oscillator 160 were operating precisely, this error count would be 0. However, in actual practice this error count will be some number. The amplitude of the error count number will depend upon the offset of the voltage control oscillator frequency from its preferred frequency. The error count at line 140 is provided to the A input of unit 142. The current control count, stored in the delay register 148, is transmitted through the line 144 to the B input of unit 142. Upon receipt of the sequencing signal B from the timing pulse generator 162 the error count at line 140 is added to the previous control count to produce a new control count which is transferred into the delay register 148. Upon receipt of the sequencing pulse D, the digital-to-analog converter produces another conversion of the input count to produce a control signal that is provided to the voltage controlled oscillator 160. This new control signal changes the rate of the oscillator 160 if the error count was anything other than zero.

The above described procedure, a single calibration pulse, can possibly bring the voltage controlled oscillator 160 into convergence with the desired frequency provided that the various counters and registers have a sufficient size to handle the maximum possible deviations. However, for more economical operation, that is, fewer and smaller components, it is possible to achieve the final desired calibration of the oscillator 160 by providing a sequence of the calibration pulses through line 36 and force the output of the oscillator 160 to converge to the desired frequency. Upon receipt of additional calibration pulses, the cycle of operation is the same as described above.

Figure 11:
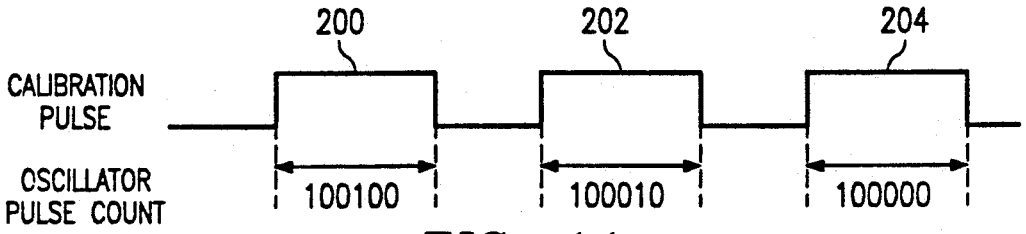
FIG. 11 is an illustration of a sequence of calibration pulses and sample count values resulting from converging oscillator rates.

It may also be necessary to have multiple calibration pulses because the gains throughout the loop are not exactly known and even with sufficient capacities for the various circuits, it may take several calibration pulses to achieve the final desired oscillator accuracy. This process is illustrated in FIG. 11, wherein the first calibration pulse 200 measures the production of 100,100 pulses from the oscillator 160 and makes a correction. The correction process changes the rate of the oscillator so that during a second calibration pulse 202 there are produced 100,010 pulses. A further correction operation is carried out. This indicates that convergence to the desired frequency of 100,000 Hz was achieved after the calibration. It must be noted that the periods of the pulses 200, 202 and 204 are the same but that the rate of the oscillator 160 is being altered. For this specific example, there is shown a loop gain of approximately 0.9. If the gain circuit is made to be 1.0 then it should be possible to make the correction with one calibration pulse, provided that the various counters, registers and arithmetic units can handle the size of counts and the error count.

Figure 7:
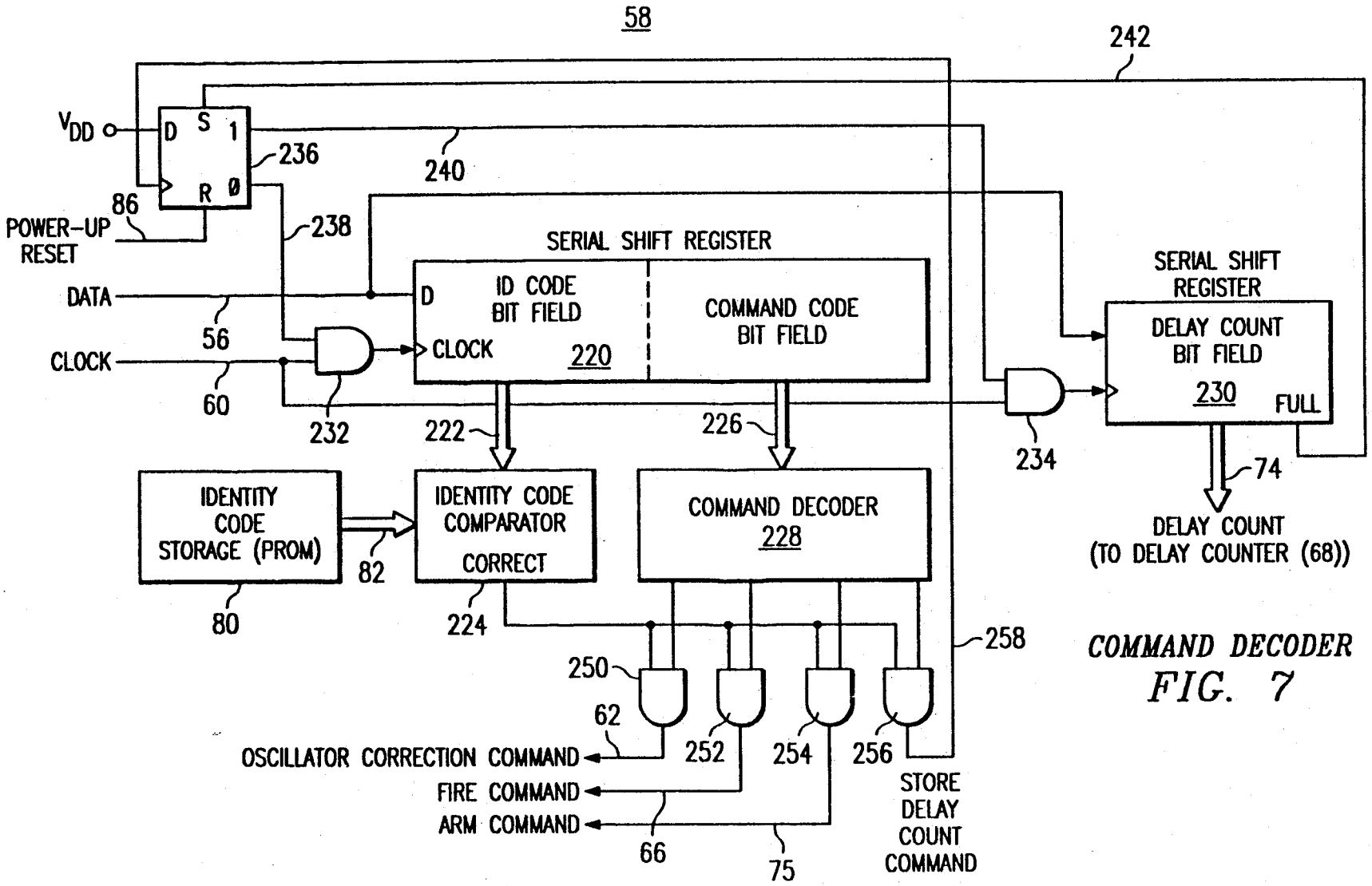
FIG. 7 is a functional block diagram for the command decoder shown in FIG. 2.

A detailed description of the command decoder 58 is presented in FIG. 7. The data signal at line 56 is input to the data input of a serial shift register 220. This shift register has two fields. The first field is an identification code bit field and the second is a command code bit field. The output from the identification code bit field is transmitted through a line 222 to an identity code comparator 224. The output from the command code bit field is transmitted through a line 226 to a command decoder 228. The identity code storage 80 provides the identity code for the particular detonation circuit through line 82 to a second input of the identity code comparator 224. The data at line 56 is further input to the data input of a second serial shift register 230.

The clock signal at line 60 is provided to the first input of an AND gate 232 and is concurrently input to the first input of a AND gate 234. The output of AND gate 232 is provided to the clock input of serial shift register 220 and the output of AND gate 234 is provided to the clock input of serial shift register 230. A D-type flip-flop 236 receives the power-up reset command from line 86 at the reset terminal thereof and the voltage supply $V_{DD}$ at the D terminal thereof. The true output of the flip-flop 236 is transmitted through a line 240 to a further input of the AND gate 234. The complement output from the flip flop 236 is transmitted through a line 238 to an additional input of the AND gate 232.

The serial shift register 230 includes a full output signal which is transmitted through a line 242 to the set input of flip flop 236. In the present embodiment it is defined that the delay count shall always have a first bit which is set to a one state and that this shall be output at the full output of the serial shift register when the complete delay count has been received.

A group of AND gates 250, 252, 254 and 256 receive the output of the command decoder as well as the output of the identity code comparator to produce various commands which are generated by the command decoder 58. The identity code comparator produces an output which is input to one input of each of the AND gates 250–256. This limits the command decoder to generating an output only when the proper identity code has been received. Upon receipt of an appropriate command within the decoder 228, an output is generated to the AND gate 250 which in turn generates a oscillator correction command at line 62. A further command activates the second input to the AND gate 252 to cause generation of the fire command at line 66. A further command causes a high level to be transmitted to the second input of the AND gate 254 to cause generation of the arm command at line 75. A still further command from the decoder 228 causes the AND gate 256 to generate an output command at a line 258. This command is store delay count. This command is transmitted to the clock input of the flip-flop 236.

Operation of the command decoder 58 is now described in reference to FIG. 7. Upon receipt of the power-up reset command the flip-flop 236 is set such that the true output is low to disable the AND gate 234 and the complement output is high to enable the AND gate 232. Thus, upon receipt of clock signal at line 60, the data will be shifted only into the serial shift register 220 and not the shift register 230. But, upon receipt of the store delay count command, the line 258 will be driven to a high state which causes the outputs of the flip-flop 236 to change state thereby changing the enablement of the AND gates 232 and 234.

Thus, upon receipt of a command indicating that a delay count will be received, the subsequent data will be transferred into the shift register 230 because that register now receives a clock signal. The delay count is then stored in the shift register 230 and is provided through the line 74 to the delay counter 68. When the full output is reached for register 230, the flip-flop 236 is changed back to its original state.

Figure 10:
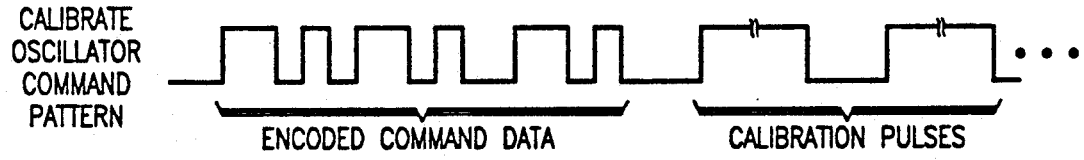
FIG. 10 is an illustration of data commands and calibration pulses in accordance with the present invention.

Encoded command data and a sequence of calibration pulses are shown in FIG. 10.

Figure 8:
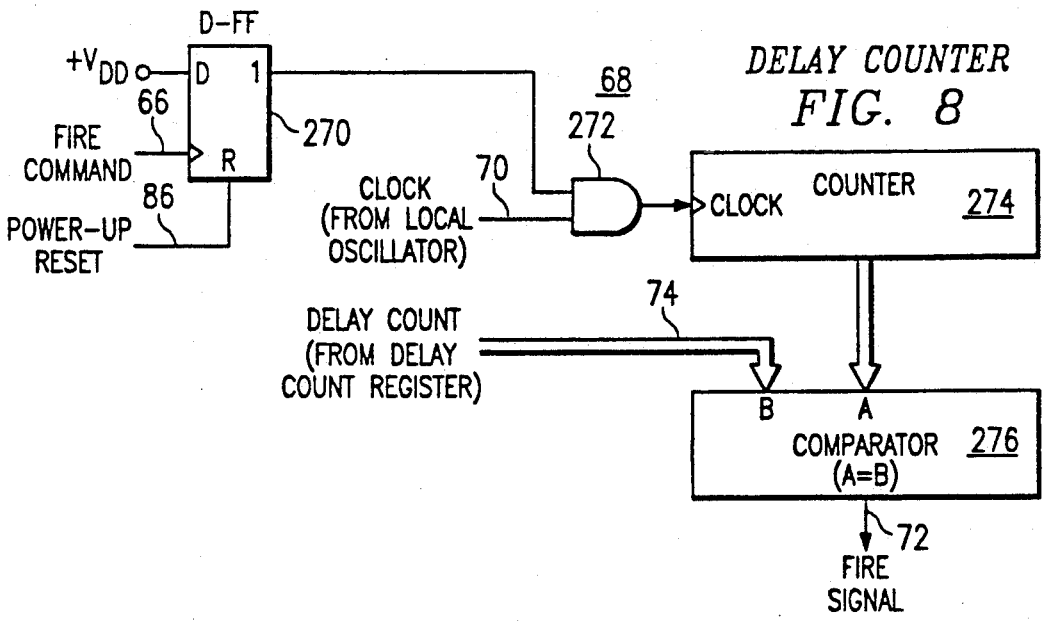
FIG. 8 is a schematic illustration of an embodiment of the delay counter shown in FIG. 2.

A detailed description of the delay counter 68 is presented in FIG. 8. The fire command at line 66 is input to the clock input of a D-type flip-flop 270. The power-up reset command at line 86 is input to the reset input of flip-flop 270. The voltage supply VDD is provided to the D input of the flip-flop 270. The true output from the flip-flop 270 is connected to a first input of an AND gate 272 and the clock signal at line 70 from the voltage controlled oscillator 160 is provided as the second input to the AND gate 272. The output from the AND gate 272 is provided to the clock input terminal of a counter 274.

The delay count transferred from the command decoder 58 through the line 74 is provided to a B input of a comparator 276. The output from counter 274 is provided to the A input of the comparator 276. When the comparison of the two numbers presented at the A and B inputs is reached, the comparator 276 produces the fire signal at line 72.

Further referring to FIG. 8, the power-up reset command at line 86 sets the initial state of the flip-flop 270 to a known condition. Upon receipt of the fire command (line 66), derived from a decoded command provided by the control unit 12, the state of the flip-flop 270 is changed to enable the AND gate 272 to receive the clock output of the oscillator 160. This clock output is transmitted through the AND gate 272 into the counter 274. The count within the counter 274 is provided to the A input of the comparator 276 and is compared to the previously received delay count provided through line 74 to the B input of comparator 276. Upon reaching a comparison condition between the two counts, the comparator 276 produces a fire signal which is transmitted through the line 72 to close the switch 46 which in turn transfers energy from the energy storage 42 into the match 48 causing ignition of the match.

In summary, the present invention is a method and apparatus for a calibrated electronic timing circuit wherein one or more precision calibration pulses are applied to the timing circuit to count the output from a variable frequency oscillator and to compare this output to a predetermined reference. This comparison produces an error signal which in turn is used to alter the voltage of the variable frequency oscillator and drive it more closely toward a predetermined frequency.

Although several embodiments of the invention have been illustrated in the accompanying drawings and described in the foregoing detailed description, it will be understood that the invention is not limited the embodiments disclosed, but is capable of numerous rearrangements, modifications and substitutions without departing from the scope of the invention.

I claim:

1. A method of operation for a time delay blasting system having a plurality of time delay ignition circuits connected to a control unit which has a time reference therein, comprising the steps of:

transmitting from said control unit concurrently to said plurality of said time delay ignition circuits a calibration pulse derived from said time reference, at each said time delay ignition circuit producing a rate signal proportional to a count of output cycles produced by an oscillator during said calibration pulse, wherein the frequency of the output signal of said oscillator is determined by a control signal provided thereto, at each said time delay ignition circuit, comparing said rate signal to a predetermined reference signal to produce an error signal, at each said time delay ignition circuit, changing said control signal by a proportion to said error signal to produce a new control signal which causes said oscillator to produce an output signal having a frequency closer than the previous output signal frequency to a predetermined timing relation to said time reference, transmitting respective time delay counts from said control unit to each of said time delay ignition circuits, transmitting a start signal from said control unit concurrently to said time delay ignition circuits subsequent to the transmission of said calibration pulse, at each said time delay ignition circuit, comparing the output produced by the corresponding oscillator to a predetermined relation to said time delay count and producing a fire signal when said predetermined relation is reached, and, at each said time delay ignition circuit, igniting a corresponding explosive element in response to the first signal produced at the time delay ignition circuit. explosive element in response to the fire signal.

2. A method of operation as recited in claim 1 wherein the steps of transmitting a calibration pulse, producing a rate signal, comparing said rate signal to a predetermined reference, and changing said control signal are repeated to produce a sequence of said output signals having frequencies which converge toward said predetermined timing relation to said time reference.

3. A delay ignition circuit for igniting an explosive element after a predetermined time delay, comprising:

an energy storage element connected to input terminals of said delay ignition circuit, a switch for connecting said energy storage element to said explosive element, a delay count storage connected to receive a delay count through said input terminals wherein said delay count determines said time delay, a variable frequency oscillator having a control signal input which determines the frequency of the output signal of said oscillator, a control signal storage connected to provide said control signal to said oscillator, a reference signal storage for storing a reference signal therein, an accumulator for storing a rate signal proportional to a number of output cycles of said oscillator during a selected time period, a difference circuit connected to said reference signal storage and said accumulator for producing an error signal proportional to the difference between said reference signal and said rate signal, a combining circuit connected to said control signal storage and said difference circuit for combining said error signal and said control signal to produce a new control signal to replace the previous control signal in said control signal storage, and a comparator for comparing the output of said oscillator with said delay count to produce a fire signal when a predetermined relation is reached, said fire signal connected to activate said switch to connect said energy storage with said explosive element for igniting said explosive element.

* * * * *

UNITED STATES PATENT AND TRADEMARK OFFICE

CERTIFICATE OF CORRECTION

PATENT NO. : 5,117,756

DATED : June 2, 1992

INVENTOR(S) : Glen P. Goffin, II

It is certified that error appears in the above-identified patent and that said Letters Patent is hereby corrected as shown below:

Column 4, Line 33, delete "wires, 18" and insert therefore --wires 18,--.

Column 5, Line 25, delete "powerup" and insert therefore --power-up--.

Column 9, Line 8, after procedure delete the extra ".".

Column 11, Line 22, delete "VDD" and insert therefore --$V_{DD}$--.

Column 11, Line 66, after "limited" insert --to--.

Column 12, Line 41, delete "first" and insert therefore --fire--.

Column 12, Lines 42-43, delete "explosive element in response to the fire signal.".

Signed and Sealed this

Thirty-first Day of August, 1993

Bruce Lehman

*Attest:*

BRUCE LEHMAN

*Attesting Officer*

*Commissioner of Patents and Trademarks*